US009938717B2

(12) United States Patent
Gaydos et al.

(10) Patent No.: US 9,938,717 B2
(45) Date of Patent: Apr. 10, 2018

(54) FACED CEILING SYSTEM

(71) Applicant: ARMSTRONG WORLD INDUSTRIES, INC., Lancaster, PA (US)

(72) Inventors: Christopher D. Gaydos, Lititz, PA (US); Brian L. Springer, Lancaster, PA (US); Lori Jo L. Shearer, Millersville, PA (US); Scott L. Huntzinger, Lancaster, PA (US)

(73) Assignee: AWI LICENSING LLC, Wilmington, DE (US)

( * ) Notice: Subject to any disclaimer, the term of this patent is extended or adjusted under 35 U.S.C. 154(b) by 0 days.

(21) Appl. No.: 14/661,413

(22) Filed: Mar. 18, 2015

(65) Prior Publication Data

US 2016/0273218 A1 Sep. 22, 2016

(51) Int. Cl.

| | |
|---|---|
| ***E04B 9/04*** | (2006.01) |
| ***E04B 9/28*** | (2006.01) |
| *E04F 13/08* | (2006.01) |
| *E04F 13/04* | (2006.01) |

(Continued)

(52) U.S. Cl.

CPC ..... *E04B 9/0435* (2013.01); *E04B 9/28* (2013.01); *E04B 9/245* (2013.01); *E04F 13/042* (2013.01); *E04F 13/08* (2013.01); *E04F 13/0837* (2013.01); *E04F 13/0864* (2013.01); *E04F 13/0885* (2013.01); *E04F 13/0889* (2013.01); *E04F 21/165* (2013.01)

(58) Field of Classification Search

CPC ..... E04B 2001/8461; E04B 9/0435; E04B 9/067; E04B 9/245; E04F 13/042; E04F 13/0889; E04F 21/165; E04F 13/08; E04F 13/0864; E04F 13/0885; E04F 13/0837

USPC ..... 52/145, 220.6, 506.07, 506.08, 506.09, 52/506.1, 417; 181/290, 291

See application file for complete search history.

(56) References Cited

U.S. PATENT DOCUMENTS 2,045,311 A * 6/1936 Roos et al. ..... 52/506.01
2,126,956 A * 8/1938 Gilbert ..... E04F 13/002 52/144
2,335,303 A * 11/1943 Olsen ..... 52/512

(Continued)

FOREIGN PATENT DOCUMENTS

CA 1229462 11/1987
DE 3502635 A1 * 7/1986 ..... E04B 5/57

(Continued)

OTHER PUBLICATIONS

International Search Report for Corresponding Application PCT/US2016/22804, dated Jun. 15, 2016. WO.

*Primary Examiner* — Adriana Figueroa
(74) *Attorney, Agent, or Firm* — Craig M. Sterner

(57) ABSTRACT

A ceiling system in one embodiment conceals joints between adjoining ceiling panels to provide a monolithic ceiling appearance. The system includes the support structure and ceiling panels each having a top surface, bottom surface, and peripheral edges. In one embodiment, the peripheral edges of the panels may have a hybrid edge detail including a first edge profile and a second edge profile different than the first. A facing material, bonded to the bottom surfaces of ceiling panels after securement to the support structure, has a continuous uninterrupted extent to cover and conceal multiple panels and joints. The facing may be adhesively bonded to the panels.

16 Claims, 14 Drawing Sheets

(51) Int. Cl.
*E04F 21/165* (2006.01)
*E04B 9/24* (2006.01)

(56) References Cited

U.S. PATENT DOCUMENTS

| | | | | |
|---|---|---|---|---|
| 2,898,640 | A | 8/1959 | Dail | |
| 3,456,411 | A * | 7/1969 | Cacossa | E04B 9/245 52/506.1 |
| 3,748,804 | A * | 7/1973 | De George | E04B 9/245 52/506.1 |
| 4,040,213 | A * | 8/1977 | Capaul | 52/145 |
| 4,117,642 | A * | 10/1978 | Eckert | E04B 9/24 52/506.1 |
| 4,830,140 | A | 5/1989 | Fridh et al. | |
| 5,079,042 | A * | 1/1992 | Frings | 427/403 |
| 5,486,394 | A * | 1/1996 | Stough | 428/61 |
| 5,628,159 | A * | 5/1997 | Younts | E04B 2/7457 52/417 |
| 6,079,177 | A * | 6/2000 | Halchuck | E04B 9/0435 52/314 |
| 7,037,572 | B2 * | 5/2006 | Gleeson | 428/192 |
| 7,536,836 | B2 * | 5/2009 | Moser Rossel | 52/506.08 |
| 7,779,964 | B2 * | 8/2010 | Birch | E04B 1/86 181/284 |
| 7,836,652 | B2 * | 11/2010 | Futterman | 52/417 |
| 8,176,701 | B2 * | 5/2012 | Cullen | B32B 3/06 52/506.1 |
| 8,635,828 | B2 | 1/2014 | Bahnmiller | |
| 8,684,134 | B2 * | 4/2014 | Dugan et al. | 181/290 |
| 8,770,345 | B2 * | 7/2014 | Dugan et al. | 181/291 |
| 8,925,677 | B2 * | 1/2015 | Dugan et al. | 181/290 |
| 2003/0154686 | A1 * | 8/2003 | Platt | E04B 9/061 52/506.05 |
| 2005/0193668 | A1 | 9/2005 | Hamilton | |
| 2010/0170616 | A1 * | 7/2010 | Boss et al. | 156/71 |
| 2011/0076470 | A1 | 3/2011 | Zaveri | |
| 2014/0000979 | A1 | 1/2014 | Dugan et al. | |
| 2014/0202788 | A1 * | 7/2014 | Hansen | E04B 1/84 181/290 |

FOREIGN PATENT DOCUMENTS

| | | | | |
|---|---|---|---|---|
| FR | 2516129 | A1 * | 5/1983 | E04B 9/068 |
| GB | 703753 | A * | 2/1954 | E04B 9/245 |
| WO | 2014/143660 | | 9/2014 | |

* cited by examiner

FACED CEILING SYSTEM

FIELD

The present invention relates to ceiling systems, and more particularly to faced ceiling systems having a monolithic seamless appearance.

BACKGROUND

A number of different materials have been used for creating seamless ceilings having a monolithic appearance. One such material is drywall. Drywall or wall board panels are surface mounted to a support surface or grid formed of wood or metal which are affixed to an overhead building structure to support the panels. Panels are affixed to the grid using fasteners. Highly visible joints formed between adjoining panels typically have relatively wide gaps which must be taped and spackled with drywall joint compound to cover the joints and fastener heads. This process is time consuming and expensive generally involving several iterations of spackling and sanding to achieve a smooth finish to conceal the joints. Furthermore, drying time must be allowed between coats of joint compound before sanding. The ceiling installation may take as long as five days in some cases and requires completion by skilled craftsman which increases installation costs. The finished joints and drywall are only now ready for applying a finish coat or paint.

The foregoing drywall ceiling installation also requires attachment of the ceiling panels to a rigid support surface or grid. Such monolithic ceiling systems may not always be suitable for attachment to suspended grid support systems, thereby limiting the number of applications in which drywall may be used. Moreover, drywall cannot deliver comparable acoustical performance to other ceiling materials such as acoustical ceiling tiles or panels which many times is desired in occupied spaces.

An improved monolithic ceiling system is therefore desired.

SUMMARY

A faced ceiling system is provided which conceals the ceiling support surface or grid with ceiling panels having specially configured peripheral edges that overlay the bottom surface or face of the grid support members. The ceiling panels in certain embodiments may include edge portions configured to mount to and conceal the exposed ceiling support surface or grid faces. In certain non-limiting embodiments, the ceiling panels may be acoustical tiles or panels.

In one embodiment, the ceiling system includes ceiling panels having a composite peripheral hybrid edge detail including a combination of a tongue-and-groove and shiplap configurations. The hybrid edges of adjoining panels are configured to both interlock via the tongue-and-groove portion of the edge detail and hide the ceiling panel support surfaces or grid faces via the shiplap portion of the edge detail.

The ceiling panels may be perimeter mounted to the support surface or grid. In one implementation, lateral extensions of the ceiling panel define an upper shiplap edge profile and mounting flanges for direct surface mounting of the ceiling panel to and hiding the ceiling support surface or grid. When the panels are assembled together in the ceiling system, a lower shiplap edge profile formed on the peripheral edge of adjoining panels in turn conceals the mounting flanges, thereby hiding any exposed fastening elements that may be used to mount the ceiling panel to the support surface or grid. Advantageously, less than the total number of peripheral edges of the ceiling panel need to be affixed to the support surface or grid in some embodiments for properly supporting the ceiling panel; the remaining edges being supported by the tongue-and-groove interlock formed with adjoining panels. This saves both installation time and fastener costs.

In one embodiment, a ceiling system includes a ceiling support structure having a downward facing support surface, and a plurality of ceiling panels attached to the ceiling support structure. The ceiling panels each have a top surface facing the ceiling support structure, an opposing bottom surface, and a plurality of peripheral edges extending between the top and bottom surfaces. A pair of adjoining first and second ceiling panels is mutually engaged along first and second mating peripheral edges respectively, the first and second peripheral edges each having a hybrid edge detail including a tongue-and-groove portion and a shiplap portion. The shiplap portion of the first ceiling panel defines a laterally extending mounting flange attached to the ceiling support structure. The shiplap portion of the second ceiling panel covers the mounting flange of the first ceiling panel. The tongue-and-groove portions of the first and second ceiling panels are interlocked, wherein the second peripheral edge of the second ceiling panel is supported via the tongue-and-groove interlock with the first ceiling panel.

In one embodiment, a ceiling panel with hybrid edge detail includes a body including a top surface, a bottom surface, opposite first and second longitudinal sides extending between the top and bottom surfaces, and opposite third and fourth lateral sides extending between the top and bottom surfaces. The first longitudinal side has a first peripheral edge including a shiplap portion and a tongue-and-groove portion. The third lateral side has a third peripheral edge including a shiplap portion and a tongue-and-groove portion. The shiplap and tongue-and-groove portions of the first and third peripheral edges are arranged to engage complementary configured shiplap and tongue-and-groove portions of adjoining ceiling panels for forming an interlocked ceiling system.

A method for concealing a ceiling support structure is provided. The method includes: providing a plurality of ceiling panels each having a top surface and an opposing bottom surface, the panels each having opposing first and second peripheral sides, the first peripheral side having a hybrid edge detail comprising a tongue-and-groove feature and a laterally extending shiplap feature adjacent the top surface, the second peripheral side having a hybrid edge detail comprising a tongue-and-groove feature and a stepped shiplap feature; attaching the first ceiling panel to the ceiling support structure; engaging the tongue-and-groove of the second peripheral side of a second ceiling panel with the tongue-and-groove feature of the first peripheral side of the first ceiling panel; and engaging the stepped shiplap feature of the second peripheral side of the second ceiling panel with the laterally extending shiplap feature of the first peripheral side of the first ceiling panel; wherein the second peripheral side of the second ceiling panel is supported by first peripheral side of the first ceiling panel.

After installation of the ceiling panels, a final facing may be installed to ceiling panels to further conceal the exposed panel-to-panel joints in furtherance of creating a monolithic ceiling appearance. In one embodiment, the facing may be installed in the field (i.e. jobsite) to cover a plurality of installed or hung ceiling panels. This type facing system is distinguishable from facing materials which are sometimes applied to the exposed bottom surfaces of a single panel or tile at the factory.

In one embodiment, a faced ceiling system includes a ceiling support structure, and a plurality of ceiling panels attached to the ceiling support structure. The ceiling panels each have a width, a length, a top surface facing the ceiling support structure, an opposing bottom surface facing an interior space below the ceiling panels, and a plurality of peripheral edges extending between the top and bottom surfaces. A plurality of joints is formed between mating peripheral edges of adjoining ceiling panels. A final facing is supported by the bottom surfaces of at least two ceiling panels; the facing covering at least a portion of the at least two ceiling panels and the joint formed therebetween to conceal the joint. The facing has a width larger than at least one of the width and length of the ceiling panels.

In some implementations, the peripheral edges of the ceiling panels have a hybrid edge detail including a tongue-and-groove portion and a shiplap portion. The tongue-and-groove portions between mating peripheral edges of adjoining ceiling panels are interlocked. The shiplap portions between mating peripheral edges of adjoining ceiling panels comprise an upper shiplap feature on one ceiling panel and a lower shiplap feature on the mating ceiling panel engaging the upper shiplap feature. In one embodiment, the facing is adhesively bonded to the ceiling panels. In some embodiments, the bottom surfaces of the panels may be treated to prepare the surfaces for adhesive bonding.

In another embodiment, a ceiling system with field-applied facing includes a grid support system comprising a plurality of orthogonally intersecting longitudinal and lateral grid support member defining an array of grid openings, and a plurality of ceiling panels attached to the grid support system. Each ceiling panel includes a pair of opposed longitudinal peripheral edges and a pair of opposed lateral peripheral edges. Joints are formed between each ceiling panel and mating longitudinal and lateral peripheral edges of adjoining ceiling panels. The peripheral edges of the ceiling panels have a hybrid edge detail including a tongue-and-groove portion and a shiplap portion. The tongue-and-groove portions between mating peripheral edges of adjoining ceiling panels are interlocked. The shiplap portions between mating peripheral edges of adjoining ceiling panels comprise an upper shiplap feature on one ceiling panel and a lower shiplap feature on the mating ceiling panel engaging the upper shiplap feature. A final facing sheet of material is adhesively bonded to bottom surfaces of a plurality of ceiling panels, wherein the facing has a continuous extent in at least one direction covering and concealing a plurality of joints between adjoining ceiling panels.

A method for facing a ceiling system is provided. The method includes: mounting an orthogonal array of ceiling panels to ceiling support structure, each ceiling panel including top and bottom surfaces, a pair of opposed longitudinal peripheral edges, and a pair of opposed lateral peripheral edges, the peripheral edges of the ceiling panels having a hybrid edge detail including a tongue-and-groove portion and a shiplap portion; forming a plurality of longitudinal joints between laterally adjoining peripheral edges of the ceiling panels; and bonding a final facing to the bottom surfaces of the ceiling panels, wherein the facing has a continuous extent in at least one direction covering and concealing the plurality of the longitudinal joints. In one embodiment, the method further comprises applying a surface treatment to the bottom surfaces of the ceiling panels before bonding the final facing. In one embodiment, the bonding step comprises applying an adhesive layer to the treated bottom surfaces to bond the final facing to the ceiling panels.

BRIEF DESCRIPTION OF THE DRAWINGS

The features of the exemplary embodiments of the present invention will be described with reference to the following drawings, where like elements are labeled similarly, and in which.

Figure 1:
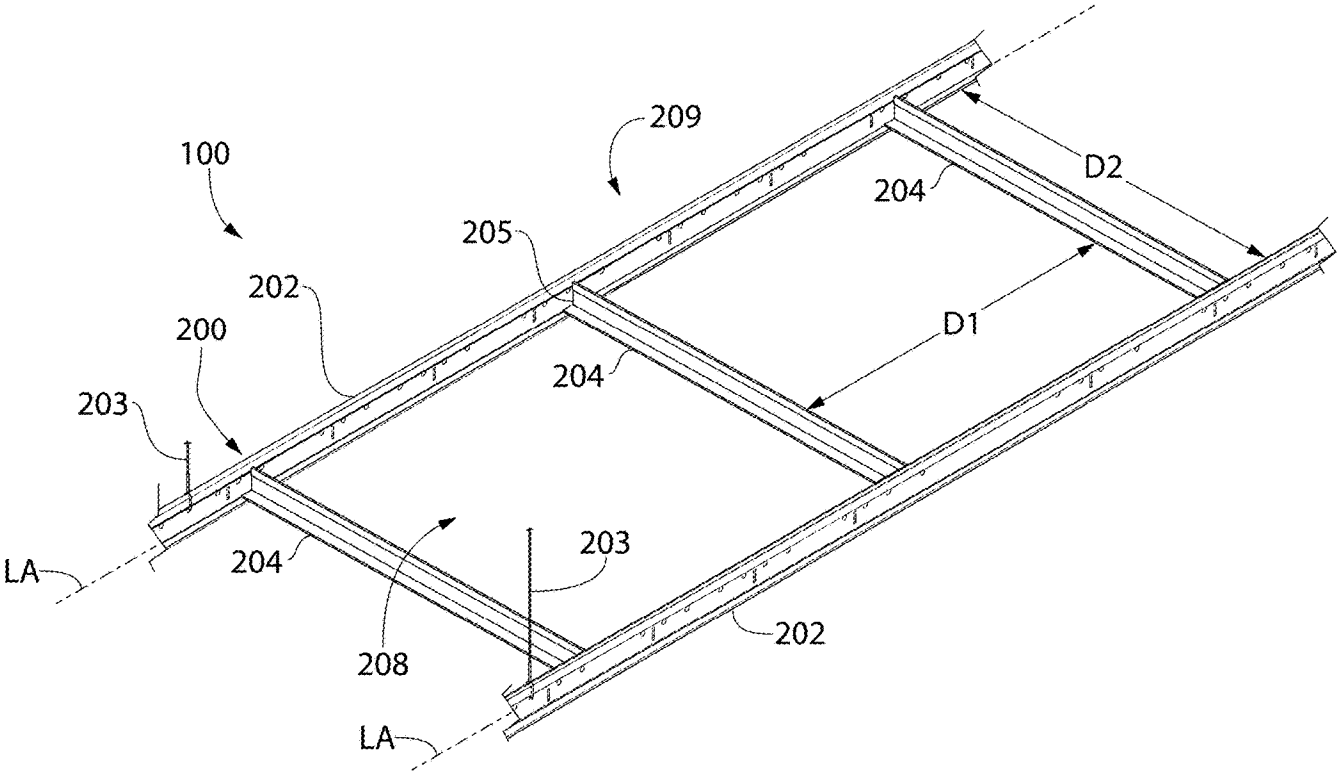
FIG. 1 is a perspective view of a ceiling panel support structure in the form of a suspended support grid formed by intersecting longitudinal and lateral grid support members.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The present ceiling system 100 will now be described for convenience without limitation to a suspended type ceiling system having a grid-type ceiling panel support system which is hung from an overhead building structure. However, the ceiling system is not limited in its scope or applicability to such grid systems. Accordingly, the support grid may be directly surface mounted to the building structure in certain embodiments. Alternatively, the ceiling panels themselves may be directly surface mounted to the building structure or framing members (e.g. wood or metal joists, studs, or other elements). Therefore, the present invention is explicitly not restricted for use with suspended type ceiling systems alone.

Figure 2:
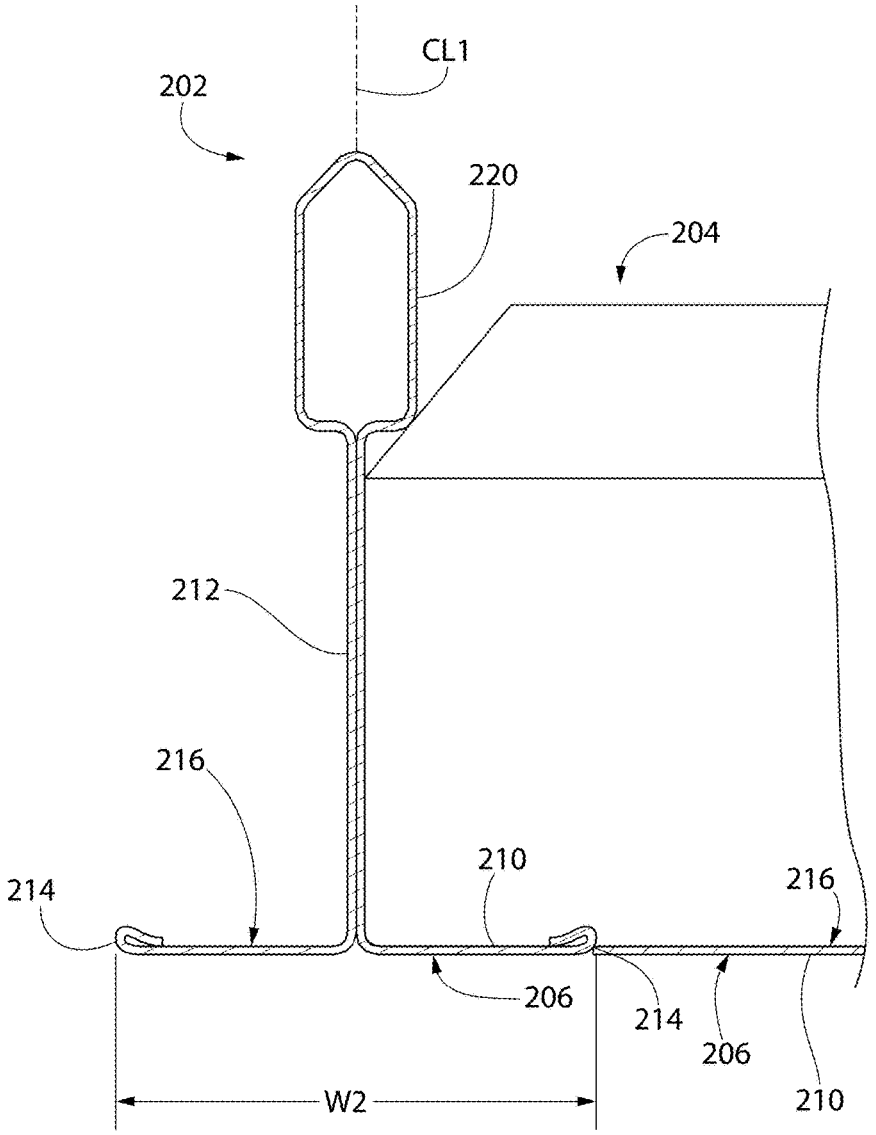
FIG. 2 is a side cross-sectional view of intersecting longitudinal and lateral grid support members.

Referring initially now to FIGS. 1 and 2, the ceiling system 100 generally includes an overhead grid support system 200 forming a ceiling support structure for mounting a plurality of ceiling tiles or panels. In one embodiment, the grid support system 200 may be configured for mounting in a suspended manner from an overhead building structure via appropriate hanger elements 203, such as for example without limitation fasteners, hangers, wires, cables, rods, struts, etc. Grid support system 200 defines a support grid 209 comprising a plurality intersecting longitudinal grid support members 202 (e.g. main beams) and lateral grid support members 204 (e.g. cross tees). The longitudinal grid support members 202 may be referred to as main beams because these grid members in some embodiments alone may be hung by hanger elements 203 from an overhead building structure, thereby providing support for the entire grid. The lateral grid support members 204 may be referred to as cross tees because these grid members are generally but not necessarily supported only by the longitudinal grid support members 202 without hanger attachment to the overhead structure.

Longitudinal and lateral grid support members 202, 204 are elongated in shape having a length greater than their respective width (e.g. at least twice), and in various embodiments lengths substantially greater than their widths (e.g. 3 times or more). Longitudinal grid support member 202 may have a substantially greater length than lateral grid support member 204 and form "runners" or "rails" which are maintained in a substantially parallel spaced apart relationship by the lateral grid support members. The lateral grid support members 204 may be attached to and between adjacent (but spaced apart) longitudinal grid support members 202 at appropriate intervals using any suitable permanent or detachable coupling means. The combination of interconnected longitudinal and lateral grid support members 202, 204 provides strength and lateral stability to the grid support system 200. In one non-limiting example, the grid support system 200 may be a metal drywall grid system or suspended grid system available from Armstrong World Industries.

In one embodiment, grid support members 202 and 204 may be horizontally oriented when installed. It will be appreciated, however, that other suitable mounted orientations of grid support members 202, 204 such as angled or sloped (i.e. between 0 and 90 degrees to horizontal) may be used. Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 which receive and essentially are closed by ceiling tiles or panels 300 when positioned within the openings. In some embodiments, the grid support members 202, 204 may be arranged in an orthogonal pattern wherein the support members intersect at right angles (i.e. perpendicular) to form rectilinear grid openings 208 such as squares or rectangles (in top plan view).

Figure 7:
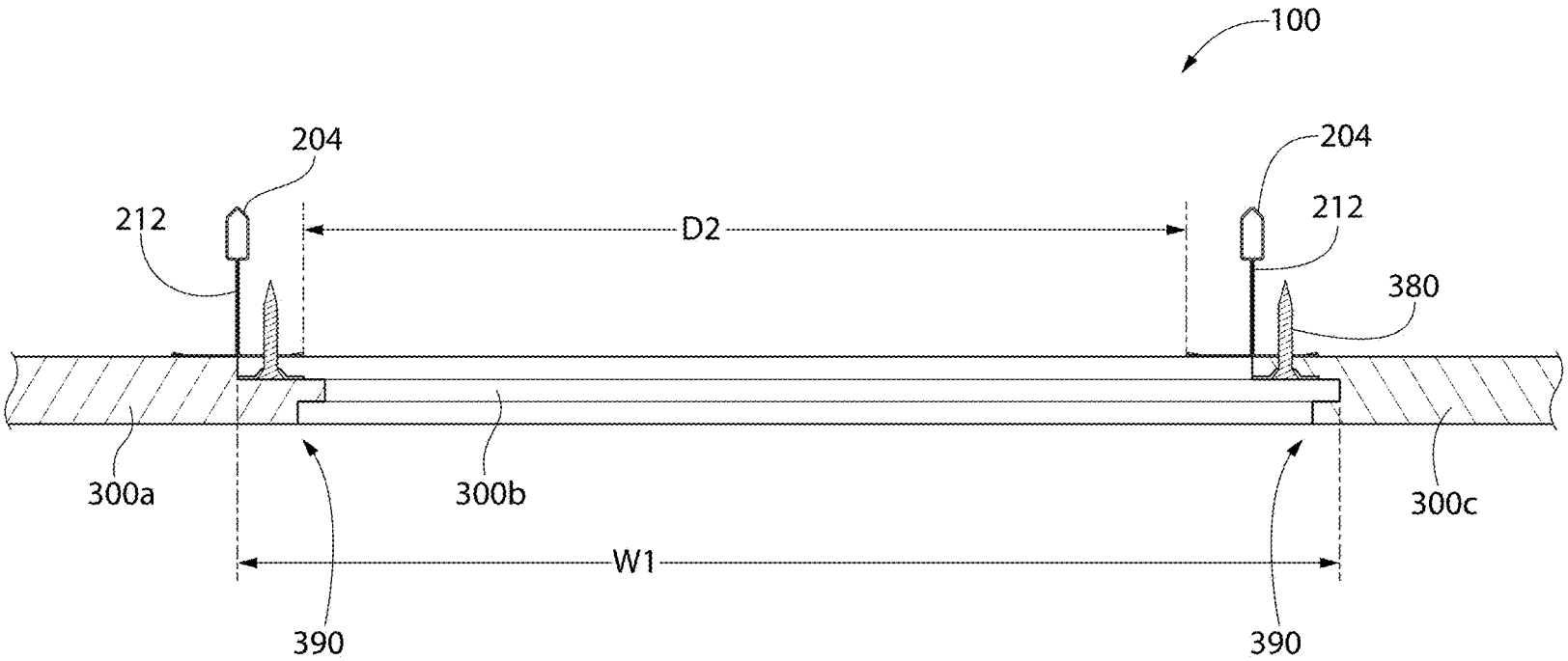
FIG. 7 is a side partial cross-sectional view of a ceiling system with ceiling panels having the hybrid edge detail.

The terminal ends 205 of the lateral grid support members 204 have end connections configured for permanent or detachable connection to the vertical webs 212 of the longitudinal grid support members 202 at right angles to form a rectilinear grid pattern (see, e.g. FIGS. 2 and 7). Non-limiting examples of suitable connection means include permanent connection such as without limitation welding, soldering, etc., or detachable connection such as without limitation clips, brackets, threaded fasteners, interlocking tabs/slots, etc. Accordingly, the present invention is not limited by the manner of attachment or coupling used. The terminal ends 207 of the longitudinal grid support members 202 have end connections configured for permanent or detachable end-to-end connection to the terminal ends of adjoining longitudinal grid support member to form continuous spans of the main beams (see, e.g. FIGS. 2 and 7). Similar permanent or detachable end connection means as those described above may be used.

It will be appreciated that some lateral grid support members 204 may be run the same direction between and parallel to main beam longitudinal grid support members 202, as shown for example in FIG. 1. Accordingly, the lateral grid support members 204 are not limited in their use to only arrangement at right angles to the longitudinal grid support members 202.

FIG. 2 is a transverse cross-sectional view of a longitudinal grid support member 202; the lateral grid support members 204 having a similar but not necessarily identical configuration in one embodiment. Referring to FIGS. 1 and 2, grid support members 202, 204 may be T-shaped (e.g. T-rails) in transverse cross section. The grid support members have an inverted T-shaped configuration in an installed position suspended from an overhead building structure. Grid support members 202, 204 may each include a longitudinally-extending horizontal bottom flange 210, an enlarged top stiffening channel 220, and a vertical web 212 extending upwards from the flange to the stiffening channel. In some embodiments, the top stiffening channel 220 may be omitted from grid support members 202 and/or 204.

The longitudinal and lateral grid support members 202, 204 each define a respective longitudinal axis LA and axial directions; the lateral grid support members 204 generally but not necessarily being arranged transversely thereto. In one implementation, bottom flange 210 is oriented substantially horizontally when in an installed hung position (see, e.g. FIGS. 7 and 8) and has opposing portions which extend laterally outwards from web 212 and terminate in opposed axially extending longitudinal edges 214. Web 212 may be centered between the edges 214 and vertically aligned with the vertical centerline CL1 of the grid support member in some embodiments. In other embodiments, the web 212 may be laterally offset from centerline CL1 of the grid support member 202 or 204 including being substantially aligned with one longitudinal edge 214 of the grid support member 202 or 204 forming a structural angle shape.

Figure 3:
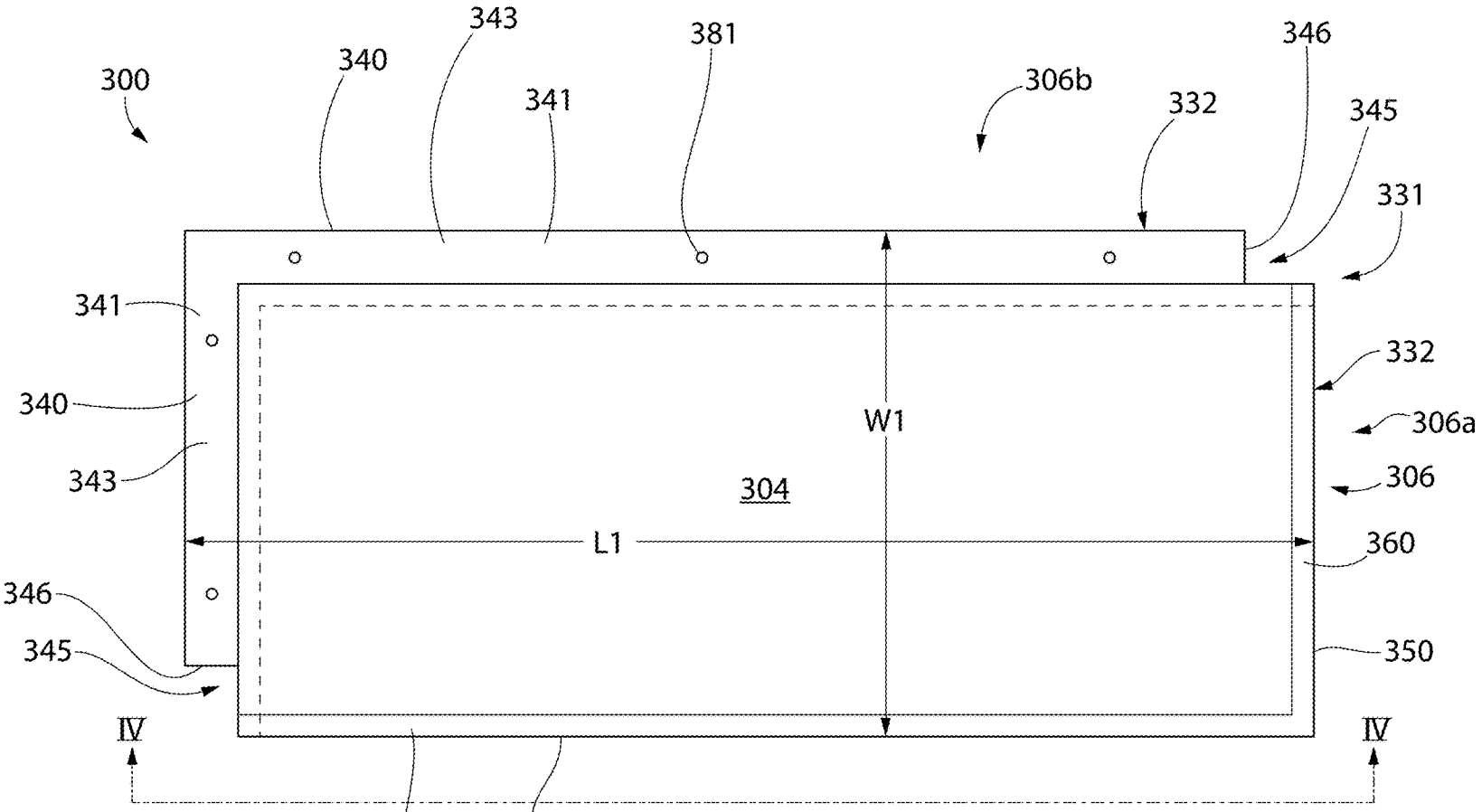
FIG. 3 is a bottom plan view of a ceiling panel with hybrid edge detail according to the present disclosure.

With continuing reference to FIGS. 1-3, the bottom flanges 210 of grid support members 202, 204 each includes a downward facing bottom surface 206 that defines the "grid face" typically visible from the occupied room or space below the grid support system 200 if not concealed. Bottom surface 206 defines a horizontal ceiling reference plane for the overhead grid support system 200. Flange 210 further defines an upward facing top surface 216, which in some embodiments may be used for supporting a portion of the ceiling panels thereon. Longitudinal grid support members 202 may be configured similarly or the same as lateral grid support members 204, or each may be different. Regardless of the configurations used for grid support members 202 and, 204, each may include bottom flanges 210 and downward facing flange surfaces 206 which preferably lie in the same horizontal plane in one embodiment when hung from an overhead building structure. Furthermore, a lower portion of the bottom flanges 201 at the terminal ends 205 of the of lateral grid support members 204 may further be omitted when fabricated or notched/cut off in the field. This facilitates flush mating with the longitudinal edges 214 of longitudinal grid support members 202 and the adjoining grid faces at intersections between longitudinal and lateral grid support members 202, 204 forming a substantially continuous grid face.

Grid support members 202, 204 may be made of any suitable metallic or non-metallic materials structured to support the dead weight or load of ceiling panels 300 without undue deflection. In some non-limiting embodiments, the grid support members may be made of metal including aluminum, titanium, steel, or other. In some non-limiting embodiments, the grid support members 202, 204 may be a standard heavy duty 15/16 inch aluminum T-rail having a 15/16 inch grid face or 9/16 inch T-rail having a narrow 9/16 inch grid face. Other types of grid support members may be used preferably with a sufficiently sized grid face for properly fastening or attaching the ceiling panels thereto.

Features of the ceiling panels mountable on the foregoing ceiling support grid will now be described in further detail. Referring generally to FIGS. 3-9, a plurality of ceiling panels 300 are attached to and supported by the grid support system 200 in openings 208.

Ceiling panels 300 may include grid-concealment features in one embodiment being configured and dimensioned to hide or conceal at least a portion of the ceiling support surface or grid face when mounted to the longitudinal and lateral grid support members 202, 204 of the grid support system 200. Accordingly, ceiling panels 300 may be used to provide a monolithic ceiling appearance which hides the ceiling support or grid surface when viewed from the occupied building space created below, as further described herein.

Referring now FIGS. 3-9, ceiling panels 300 may have a generally flattened body with a substantially greater horizontal width W1 and length L1 than vertical thickness as shown. Ceiling panel 300 has a body including a top surface 302 facing upward toward the grid support member when mounted, an opposing bottom surface 304, and peripheral sides 306 extending therebetween along the perimeter of the ceiling panel. Top and bottom surfaces 302, 304 may be generally planar and arranged substantially parallel to each other in one non-limiting embodiment. In the exemplary non-limiting embodiment shown, ceiling panel 300 has a rectangular shape having a length L1 and longitudinal peripheral sides 306*b* which are larger than width W1 and lateral peripheral sides 306*a*. In other embodiments, however, square ceiling panels 300 may be used.

Figure 4:
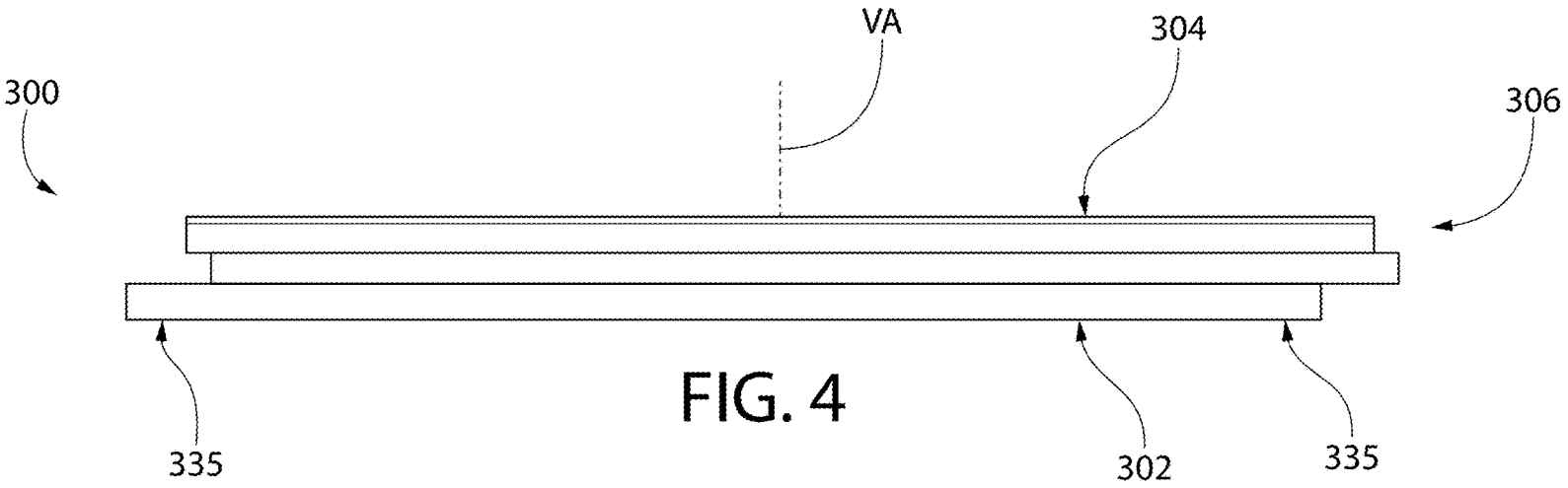
FIG. 4 is a side elevation view thereof.
Figure 5:
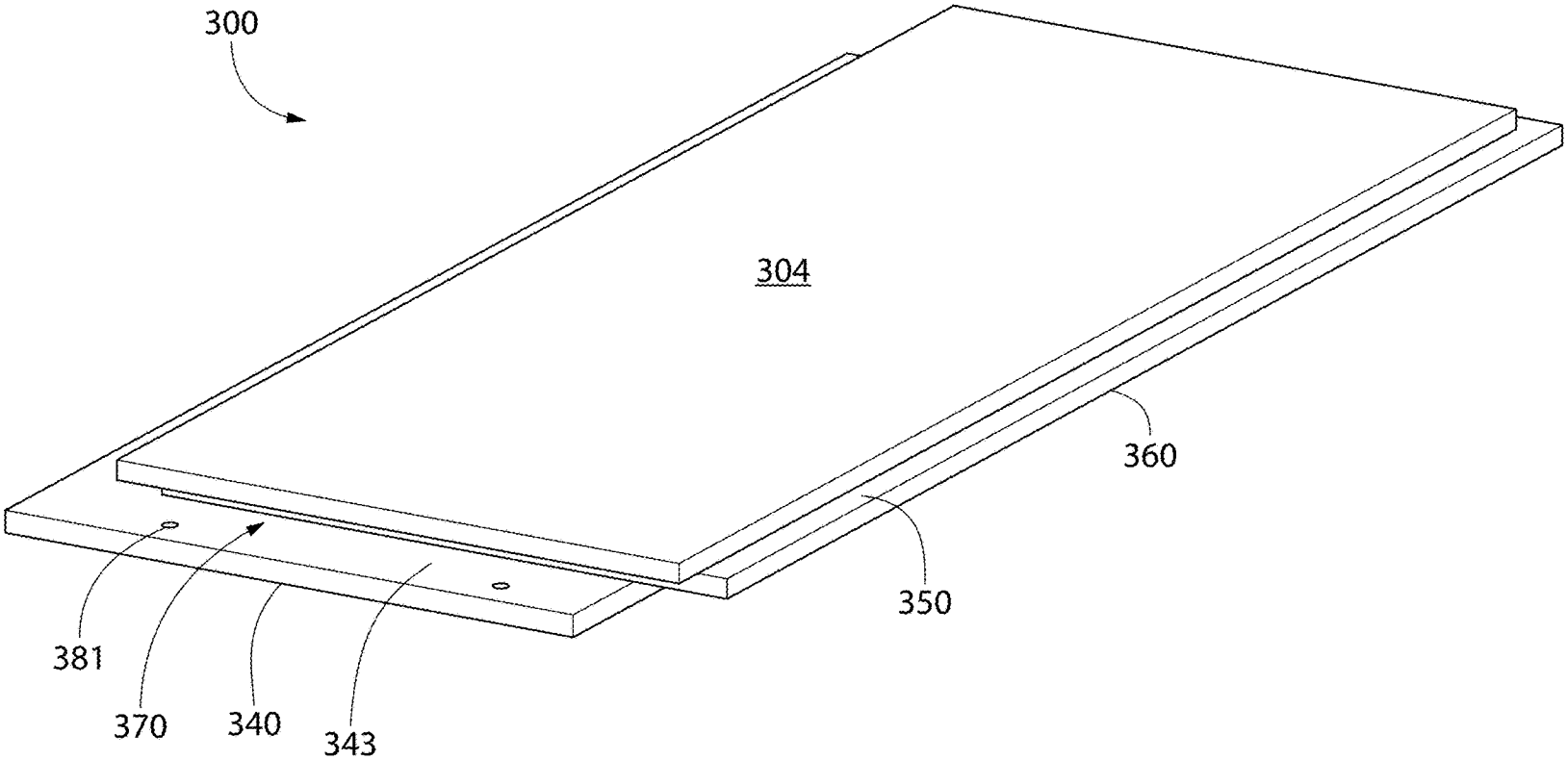
FIG. 5 is bottom perspective view thereof.
Figure 6:
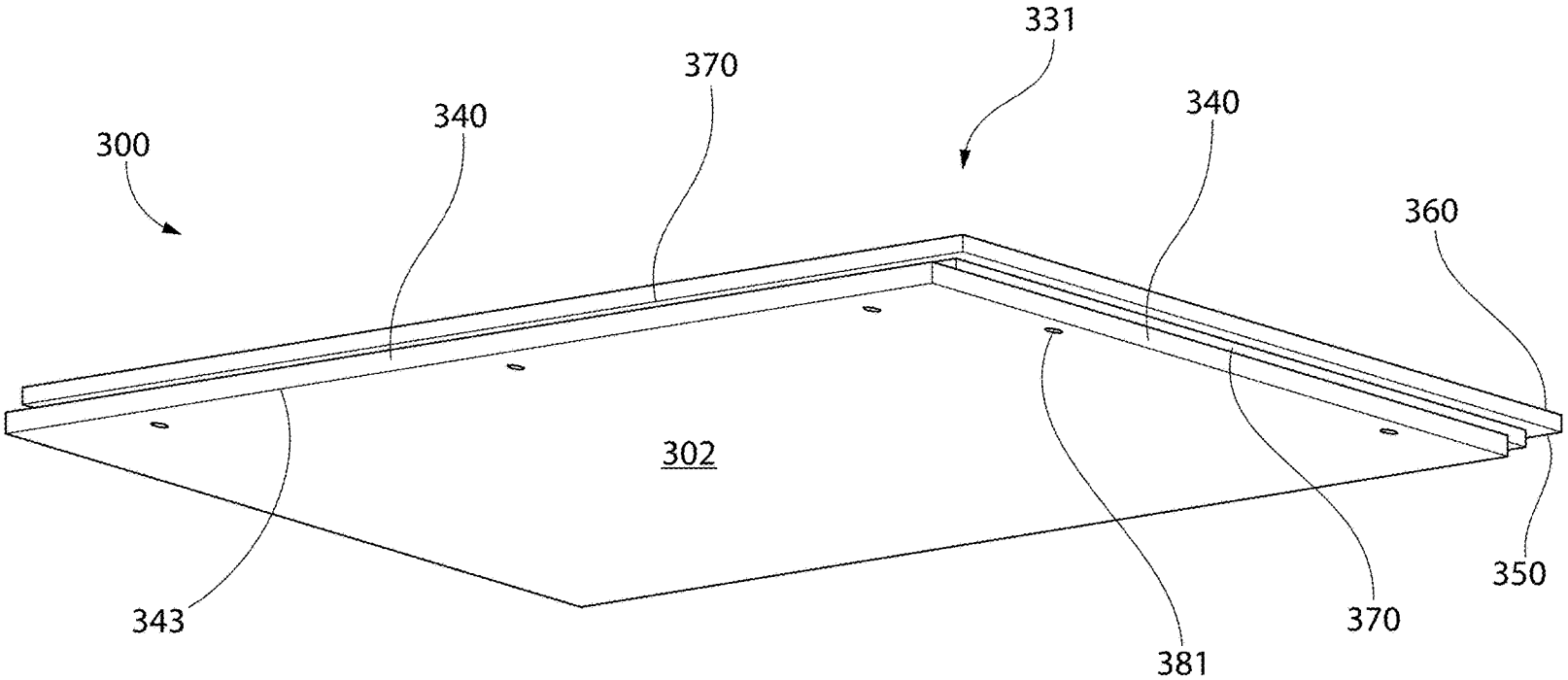
FIG. 6 is a top perspective view thereof.

For clarification, it bears noting that the ceiling panel shown in FIGS. 4 and 6 is oriented so that top surface 302 (normally hidden from view in the interior space formed below the ceiling system) is facing downward and the exposed bottom surface is facing upward for better revealing the edge details. This is opposite to the installed position of the ceiling panels shown in FIGS. 7-9, in which the panel is inverted 180 degrees for mounting to the grid support system 200 (i.e. top surface 302 facing upwards and bottom surface 304 facing downwards).

In some embodiments, ceiling panels 300 may have a rectilinear shape, such as without limitation square or rectangular. Each ceiling panel 300 includes four corners 331 and peripheral edges 332 extending around the perimeter of the panel. Edges 334 define outward facing peripheral edge surfaces configured to interlock with adjoining ceiling panels 300 when mounted to the grid support system 200, as further described herein.

The ceiling panels 300 are configured and dimensioned to hide the grid face of the overhead support grid 209 (i.e. bottom surface 206 of the grid support members 202 and 204). Accordingly, referring to FIGS. 1-9, ceiling panels 300 each have a horizontal longitudinal length L1 (measured parallel to longitudinal axis LA) which is larger than the corresponding horizontal longitudinal distance D1 (measured parallel to longitudinal axis LA) between the inner longitudinal edges 214 (i.e. closest distance) of two adjacent albeit spaced apart grid lateral grid support members 204. In some embodiments, ceiling panels 300 may each further have a horizontal lateral width W1 (measured transversely to longitudinal axis LA) which is larger than the corresponding horizontal lateral distance D2 (measured transversely to longitudinal axis LA) between the inner longitudinal edges 214 (i.e. closest distance) of two adjacent albeit spaced apart grid longitudinal grid support members 202. In one embodiment, width W1 is substantially equal to distance D2 plus more than the width W2 of each of the two flanges 210 of the longitudinal grid support members 202 which support both opposite longitudinally-extending peripheral sides 306 of the panel (see, e.g. FIGS. 1, 2, and 7) Similarly, in one embodiment, length L1 is substantially equal to distance D1 plus more than the width W2 of each of the two flanges 210 of the lateral grid support members 204 which support both opposite laterally-extending sides 306 of the panel. In one implementation, one peripheral edge 332 of each ceiling panel 300 may terminate at a point coextensive with or beyond the outermost longitudinal edge 214 of the first of each pair of adjacent but spaced apart longitudinal and lateral grid support members 202, 204. The opposite peripheral edge 332 of each ceiling panel 300 may terminate at a point coextensive with the vertical web 212 of the second of each pair of adjacent but spaced apart longitudinal and lateral grid support members 202, 204.

Accordingly, when adjoining ceiling panels 300 are installed in the overhead support grid 209 which are configured and dimensioned in the foregoing manner, the peripheral edge portions 332 of the panels overlap and extend entirely beneath the flange bottom surfaces 206 of both the two opposing longitudinal grid support members 202 and two opposing lateral grid support members 204 surrounding each grid opening 208, thereby completely concealing the grid face. Perimeter regions of top surface 302 of each ceiling panel 300 define upward facing substantially planar peripheral top surfaces 335 which may either contact or fall in close proximity to bottom surfaces 206 of grid support members 202 and 204 when the ceiling panel is mounted therefrom (see, e.g. FIGS. 4, 7, and 8).

The ceiling panels 300 may have a composite-structured hybrid peripheral edge detail including a combination of a tongue-and-groove and shiplap configurations. The hybrid edges of adjoining panels are configured to both interlock via the tongue-and-groove portion of the edge detail and hide the ceiling panel support surfaces or grid faces via the shiplap portion of the edge detail.

Figure 8:
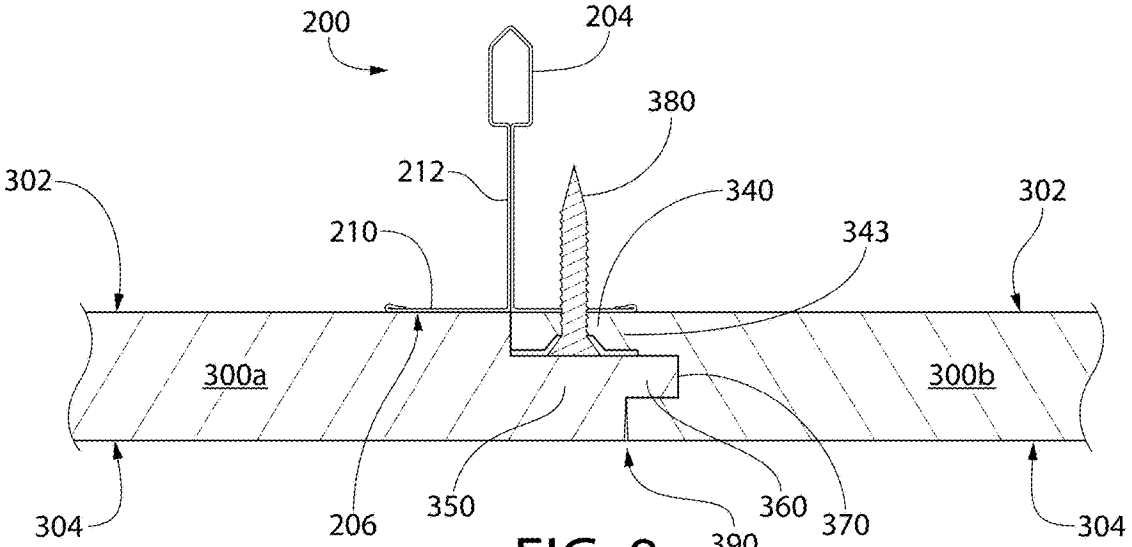
FIG. 8 is an enlarged detail of one of the joints between adjoining ceiling panels in FIG. 7.
Figure 9:
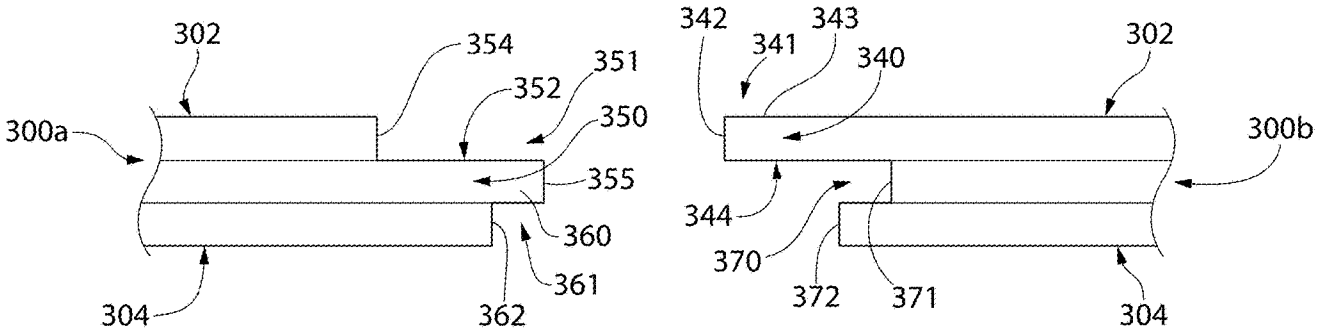
FIG. 9 is an exploded view thereof with the grid support member showing the hybrid shiplap and tongue-and-groove edge details of the panels.

Referring to FIGS. 3-9, each peripheral edge 332 preferably but not necessarily includes a shiplap portion comprising either an upper shiplap profile or feature 340 adjacent top surface 302 or a lower shiplap profile or feature 350 offset and spaced vertically apart/downward from the top surface of each panel 300 (best shown in FIG. 9). The upper shiplap features of one ceiling panel 300 has a complementary configuration and arrangement to the lower shiplap features 350 on an adjoining panel so that the assembled shiplap edges form a completed shiplap joint or seam when mutually engaged.

In one exemplary non-limiting embodiment as shown, each ceiling panel 300 may include two peripheral edges 332 having a male upper shiplap feature 340 and two peripheral edges 332 having a female lower shiplap feature 350. In one configuration, the upper shiplap features 340 may be formed on two orthogonally adjoining peripheral edges 332 (i.e. oriented perpendicular to each other) which intersect at a first corner 331. Similarly, the lower shiplap feature 350 may be formed on two orthogonally adjoining peripheral edges (i.e. oriented perpendicular to each other) which intersect at a second corner 331 diagonally opposite to the first corner 331. The upper shiplap features 340 may be continuous in structure on the two adjoining peripheral edges 332 including at the first corner. Similarly, the lower shiplap features 350 may be continuous in structure on the two adjoining peripheral edges 332 including at the second corner.

It will be appreciated that other arrangements of the shiplap features on different peripheral edges may be used in other embodiments. Accordingly, the ceiling panel is not limited to the shiplap arrangement shown herein.

In one embodiment, each upper shiplap feature 340 may be defined by a cantilevered lateral extension 341 of a respective first ceiling panel edge 332 (reference FIGS. 3-9 with particular initial emphasis on FIG. 9 showing the disassembled shiplap joint of FIG. 8 between two adjoining panels 330*a*, 300*b*). The top of the extension 341 may be flush with and coextensive with the top surface 302 of the main body of the ceiling panel 300, thereby creating a continuous planar top surface 302. Other configurations may be used.

Upper shiplap feature 340 includes a laterally outward facing upper end surface 342 and downward facing bottom surface 344 arranged to engage a mating lower shiplap feature 350 of an adjoining ceiling panel 300. Bottom surface 344 may be oriented substantially parallel to top surface 302 of ceiling panel 300. In other embodiments, bottom surface 344 may be obliquely oriented to top surface 302. The lateral extension 341 preferably has a width sufficient to cover and at least a portion of the grid bottom flange 210 (i.e. grid face or surface 206) to which the ceiling panel is attached. In one embodiment, end surface 342 may be vertically aligned approximately with the web 212 of the grid support member 202 or 204 to which it attached (see, e.g. FIGS. 7 and 8). In other embodiments, the end surface 342 of lateral extension 341 may align elsewhere on the flange 210.

In one configuration, the lateral extension 341 further defines a mounting flange 343 for attachment to the grid bottom flange 210 (see, e.g. FIGS. 7 and 8). The mounting flange 343 is configured and arranged for permanent or detachable engagement with grid flange 210. Non-limiting examples of suitable attachment means include permanent joining such as without limitation non-releasable adhesives, etc., or detachable joining such as without limitation threaded fasteners 380 (shown), clips, brackets, interlocking tabs/slots, releasable adhesives, etc. If fasteners 380 are used, mounting holes 381 may be provided to facilitate attaching the ceiling panel 300 to the support grid. The invention is not limited in scope or applicability by the method used to attach the mounting flange to the grid support members.

With continuing reference to FIGS. 3-9, the lower shiplap feature 350 may be defined by an end recess 351 formed in a respective second ceiling panel edge 332. Lower shiplap feature 350 includes a horizontal upward facing seating surface 352, laterally outward facing end surface 355, and a vertical upper stop wall 354 adjacent to the top surface 302 of ceiling panel 300. Seating surface 352 may be oriented substantially parallel to top surface 302 of ceiling panel 300. In other embodiments, seating surface 352 may be obliquely oriented to top surface 302. Seating surface 352 of lower shiplap feature 350 is arranged to engage bottom surface 344 of an upper shiplap feature 340 when the ceiling panel joint is fully assembled, as shown in FIGS. 7 and 8.

Stop wall 354 may be oriented perpendicular to and intersects top surface 302 of the ceiling panel 300 at one end. At the other end, stop wall 354 intersects and may be oriented perpendicular to seating surface 352 as best shown in FIG. 9. In other embodiments contemplated, stop wall 354 may be obliquely oriented to the top surfaces 302 and 352 of the ceiling panel 300 and lateral extension 351, respectively. The stop wall 354 is laterally/horizontal spaced inward and vertically offset from the end surface 355 of the peripheral edge 332. Stop wall 354 may be oriented parallel to end wall 355 in some embodiments. In other embodiments, stop wall may be obliquely oriented to end wall 355.

The tongue-and-groove portion of the ceiling panel edge detail will now be further described. In one embodiment, the peripheral edges 332 including a lower shiplap feature 350 may further include a male shiplap feature comprising a laterally outward projecting cantilevered tongue 360 configured for insertion into a mating female shiplap feature comprising a laterally open groove 370 formed in an adjoining ceiling panel peripheral edge 332 (see, e.g. FIGS. 8 and 9). The free terminal end of tongue 360 defines the peripheral edge end surface 355 of the ceiling panel. Tongue 360 defines an edge recess 361 and lower stop wall 362 disposed at and adjoining the bottom surface 304. Stop wall 362 is spaced laterally inwards from and vertically offset from end surface 355 of the ceiling panel edge. In one embodiment, the lower stop wall 362 is spaced inward from end surface 355 by a distance less than the spacing between end surface 355 and the upper stop wall 354. In one embodiment, lower stop wall 361 may be oriented parallel to upper stop wall 354, and in further embodiments also parallel to end wall 355. Other orientations including oblique may be used.

Lateral groove 370 defines a recessed vertical stop wall 371 arranged to abut the tongue 360 of an adjoining panel, and more particularly the end surface 355 of the tongue as shown in FIG. 8. Stop wall 371 is laterally offset inward and spaced apart from the end surface 342 of the cantilevered lateral extension 341. Stop wall 371 limits the insertion depth of the tongue into the groove. A laterally outward facing lower end surface 372 adjoins the groove 370 and bottom surface 304 of the ceiling panel 300. In one embodiment, end surface 372 is laterally offset inward and spaced apart from the top end surface 342 of the cantilevered lateral extension 341. In one embodiment, end surface 372 is spaced inward from top end surface 342 by a distance less than the spacing between end surface 372 and the recessed stop wall 371. In one embodiment, lower end surface 372 may be oriented parallel to upper end surface 342, and in further embodiments also parallel to recessed stop wall 371. Other orientations including oblique may be used.

In one embodiment, the lateral extension 341 (and mounting flange 343 defined by the extension) may have an L-shaped configuration as show in the bottom plan view of FIG. 3. The lateral extension 341 is therefore arranged on the perimeter of the ceiling panel on two adjacent and orthogonal peripheral edges 332. In certain embodiments, the terminal ends 346 of the lateral extensions may have a length less than the peripheral edge 332 on which it is disposed. Accordingly, the terminal ends 346 may be longitudinally or laterally offset from the parallel peripheral edges of an adjacent ceiling panel to form a corner space or notch 345 for receiving a portion of the lateral extension 341/mounting flange 343 of an adjoining and interlocking panel (see, e.g. FIGS. 10 and 11).

The protruding tongue 360 portions of the ceiling panels 300 may have also an L-shaped configuration in bottom plan view. The tongues 360 may have a length substantially equal to the length of the peripheral edge 332 on which they are disposed (see, e.g. FIG. 3).

FIG. 7 shows ceiling panel joints formed with the hybrid edge detail disclosed herein. This figure shows the ceiling panel joints formed on the shorter peripheral sides 306*a* of a central ceiling panel 300*b*. Ceiling panel 300*b* is interlocked with two adjoining ceiling panels 300*a* and 300*c* (shown hatched in cross-section for clarity) on opposite peripheral edges of ceiling panel 300*b*. FIG. 8 is a detailed view of the left joint; the right joint being similar. FIG. 9 is an exploded or disassembled view of the joint of FIG. 8.

Referring to FIGS. 7-8, one peripheral edge 332 (left) of the central ceiling panel 300*b* is threadably fastened to a first lateral grid support member 204 using the mounting flange 343 defined by lateral extension 341 of the upper shiplap feature 340 and fasteners 380. With respect to the shiplap portion of the hybrid edge details, the upper shiplap feature 340 of ceiling panel 300*b* is seated on the lower shiplap feature 350 of ceiling panel 300*a* such that bottom surface 344 of the upper feature is engaged with seating surface 352 of the lower feature. The seating surface 352 defines a stepped configuration dimensioned to receive the upper shiplap feature 350 so that the top surfaces of adjoining ceiling panels 300 are substantially flush with each other. End surface 342 abuttingly contacts or alternatively may be disposed preferably at least proximate to upper stop wall 354.

Advantageously, when the shiplap features of the ceiling panels 300*a*, 300*b* are joined, the lower shiplap feature 350 is arranged to completely conceal the otherwise exposed heads of the fasteners 380, thereby eliminating the need to spackle or otherwise hide the head of the fastener for forming a monolithic ceiling appearance.

With respect to the tongue-and-groove portion of the hybrid edge details, tongue 360 of ceiling panel 300*a* is inserted in and engaged with lateral groove 370 of ceiling panel 300*b*. End surface 355 of tongue 360 abuttingly contacts or alternatively may be disposed preferably at least proximate to recessed stop wall 371 in groove 370 to provide secure interlocked engagement between the adjoining peripheral edges 332 of each panel. Lower end surface 372 of ceiling panel 300*b* abuttingly contacts or alternatively may be disposed preferably at least proximate to lower stop wall 362 of ceiling panel 300*a*.

It should be noted that the remaining peripheral edge 332 (right) of the central ceiling panel 300*b* is supported only by tongue-and-groove engagement with ceiling panel 300*c*, thereby eliminating the need to fasten this peripheral side 306 of ceiling panel 300*b* to the support grid. The same joint configuration and arrangement as described above is used for joining the longitudinal peripheral sides 306*b* of ceiling panel 300*b* to adjoining ceiling panels (see, e.g. FIGS. 10 and 11). Accordingly, the hybrid edge details according to the present disclosure allow each ceiling panel to be attached to a grid support member along only two of the four peripheral sides, thereby advantageously reducing installation time and costs.

Ceiling panels 300 may be constructed of any suitable material or combinations of different materials, which in certain embodiments preferably have acoustical properties. Some non-limiting examples of ceiling panel materials that may be used include, without limitation, mineral fiber board, fiberglass, metals, polymers, wood, composites, combinations thereof, or other. Embodiments of ceiling panels 300 have a sufficiently high noise reduction coefficient (NRC) and ceiling attenuation class (CAC) rating to be characterized as an acoustical substrate in contrast to gypsum-based drywall having substantially lower NRCs (e.g. 0.05) characteristic of sound reflecting, not absorbing materials. NRC is a measure of sound energy absorption of a material. An NRC rating of 0 is a perfect sound reflection material. An NRC rating of 1 is a perfect sound absorption material. CAC is a measure for rating the performance of a ceiling material as a barrier to block airborne sound transmission through the material to/from the plenum above the ceiling.

In some embodiments, ceiling panels 300 according to the present disclosure may have an NRC of at least 0.50 and/or CAC of at least 30 depending on the desired acoustical characteristics of the ceiling system. In a certain embodiment, the NRC rating may be at least 0.70. The shiplap and tongue-in-groove edge details may be formed by any fabrication process or combination of processes capable of making the details. Non-limiting examples include cutting, routing, milling, casting, molding, etc.

In some embodiments contemplated, ceiling panels 300 may be composite structures formed from two or more separately formed layers or sheets of material which are bonded or joined together to form a complete panel. For example, referring to FIGS. 3-6 and 9 in a three layer/sheet construction, a top layer/sheet comprising the top surface 302, upper shiplap feature 340 and mounting flange 343 could be one layer/sheet. A bottom layer/sheet comprising the bottom surface 304 could be a second layer/sheet. And a middle or core layer/sheet forming the tongue-and-groove features on opposing sides could be a third layer/sheet. Any suitable method could be then used to join the sheets together, including as possible examples without limitation depending on the layer/sheet materials used adhesive bonding, fasteners, welding, soldering, etc.

Figure 10:
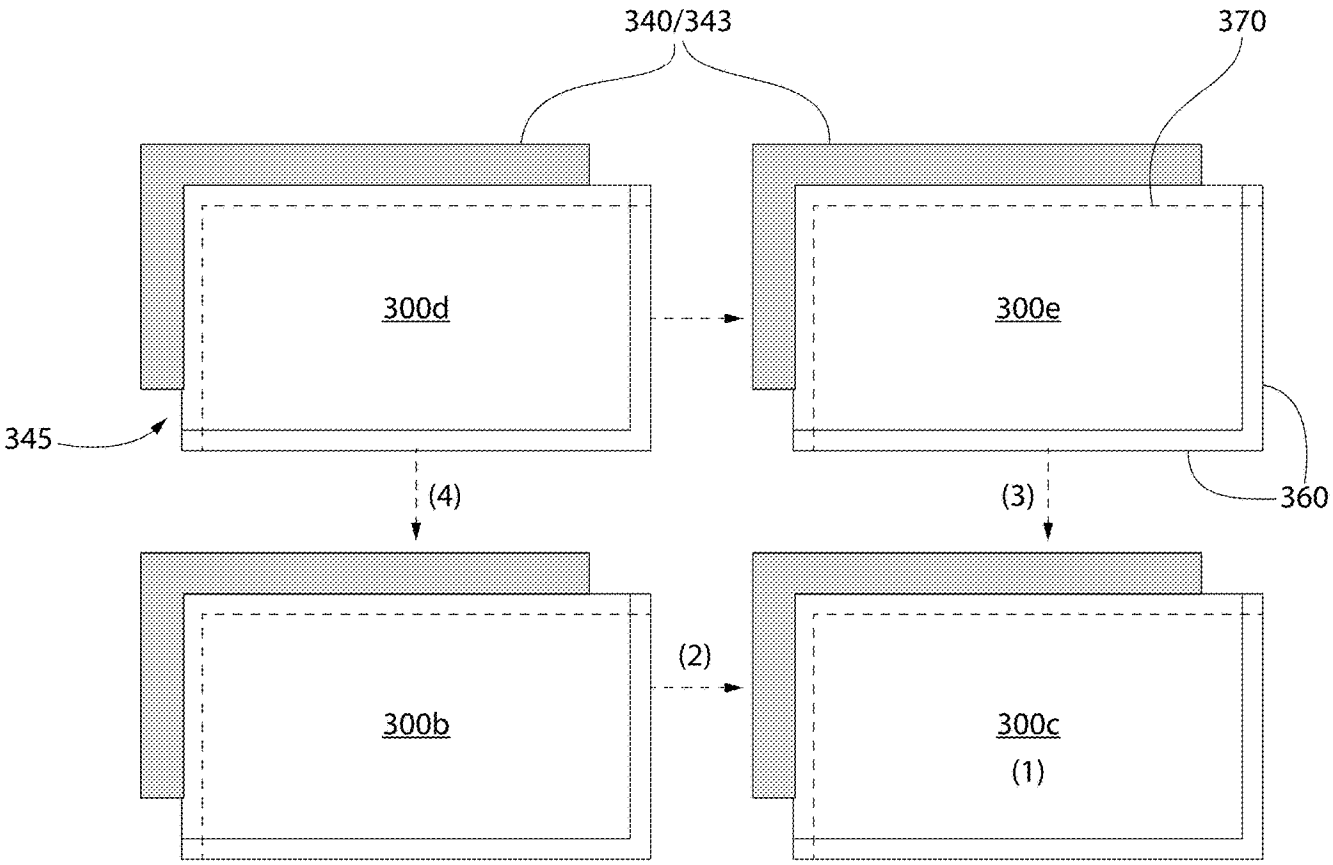
FIG. 10 is an exploded bottom plan view of a ceiling panels showing one non-limiting embodiment of an assembly or installation sequence.
Figure 11:
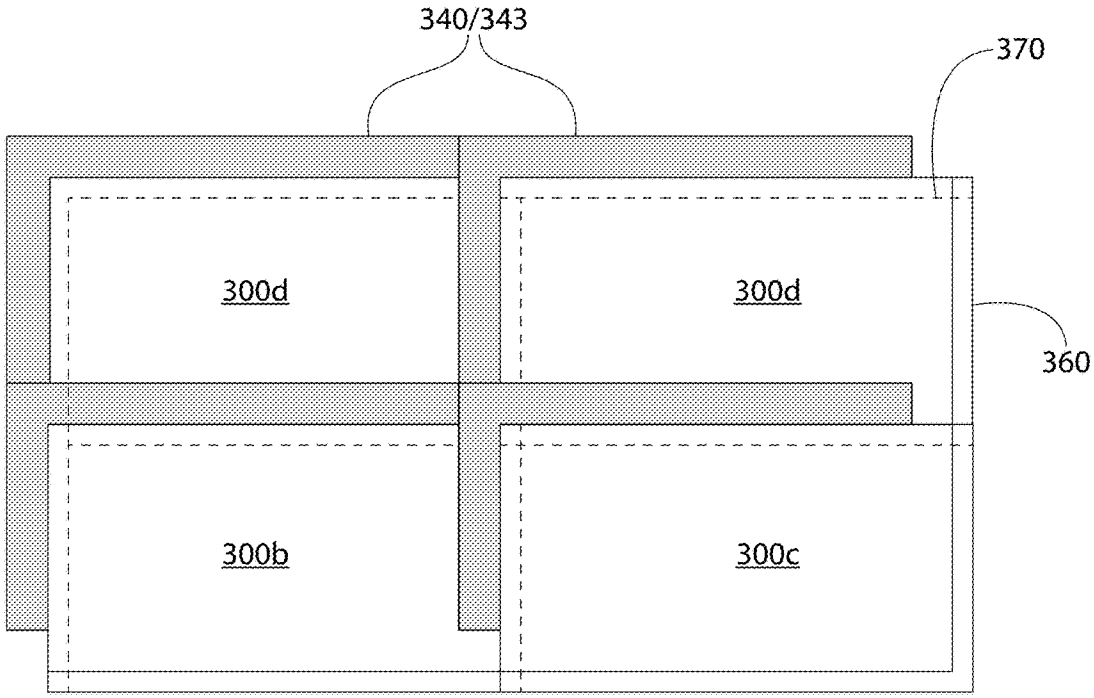
FIG. 11 is a bottom plan view showing the assembled ceiling panels.

An exemplary method for installing a ceiling system that conceals the ceiling support structure will now be described. In order to form a monolithic appearance for ceiling system 100, the ceiling panels 300 are mounted and assembled in an alternating sequence using the mounting flanges 342, and tongue-and-groove and shiplap edge details disclosed herein. FIGS. 10 and 11 are bottom plan views of exemplary ceiling panels 300 in a preassembly exploded view and assembled view, respectively.

The grid support system 200 is first installed using a combination of longitudinal and lateral grid support members 202, 204 in the manner described herein and shown in FIG. 1. For this exemplary method, it will be assumed without limitation that the ceiling panels and the grid openings 208 are rectangular in shape. The same installation methodology may be used if the ceiling panels were square.

The present method begins with first installing a row of ceiling panels 300 along the longitudinal direction between pairs of lateral grid support members 204. For a suspended ceiling system, the grid support members are first hung from an overhead building structure. Alternatively, in some embodiments, the grid support members may be surface mounted directly to the building structure, or alternatively the surface of the building structure itself may be used for direct attachment of the ceiling panels 300 if the surface is sufficiently flat. The present method, however, will be described for convenience without limitation to a suspended-type ceiling system. The grid support members 202, 204 are installed in an arrangement similar to FIG. 1 with grid openings 208 formed to receive ceiling panels 300 therein.

Referring now to FIGS. 7-10, the method continues by now mounting the ceiling panels. In step (1), a first ceiling panel 300*c* is centered below a first grid opening 208. The longitudinal and lateral mounting flanges 343 of panel 300*c* (which includes upper shiplap feature 340) are positioned beneath and then attached along two peripheral sides 306 to bottom flanges 210 of intersecting longitudinal and lateral grid support members 202, 204 (see also FIG. 3). Fasteners 380 may be used in one embodiment to secure the ceiling panel 300*c* to the grid support members. The mounting flange 383 of ceiling panel 300*c* covers approximately one-half the bottom grid surface 206 (i.e. grid face) of the grid support member. The other half of the grid surface 206 remains exposed at this point in the ceiling installation process. The upper end surface 342 of the ceiling panel 300*c* is aligned approximately with the vertical web 212 of the grid support member. This ceiling panel will now be used as the "base or foundation" panel for then sequentially installing the remaining ceiling panels, preferably in a predetermined order or sequence.

A second ceiling panel 300*b* is next installed in step (2) and connected to ceiling panel 300*c* (see FIG. 10). The lateral tongue 360 on panel 300*b* is fully inserted into the lateral groove 370 presented beneath the mounting flange 343 of ceiling panel 300*c* already attached to the support grid 209. This supports the tongued lateral side of ceiling panel 300*b*, which itself is not attached directly to the grid support member 202 or 204 (see, e.g. FIGS. 7-8). This assembly step also engages the lower slap feature 350 formed above tongue 360 with the upper shiplap feature 340 of ceiling panel 300*c*.

It bears noting that the foregoing single step (2) achieves several objectives. First, referring to FIG. 4 (showing joint similar in configuration to present joint formed between ceiling panels 300*b* and 300*c*), the top surface 302 of ceiling panel 300*b* covers the remaining previously exposed one-half of the grid support member bottom surface 206 to which mounting flange 343 of ceiling panel 300*c* was attached in step (1). The lower shiplap feature 350 of ceiling panel 300*b* covers the exposed head of fastener 380. Preferably, the lower shiplap feature 350 should have a length or lateral projection sufficient to cover the fastener. Furthermore, a relatively narrow and tight seam or joint 390 is formed between the bottom surfaces 304 of ceiling panels 300*b*, 300*c* which lie in the same horizontal plane. This is intended to eliminate the need for applying joint compound or spackling to hide the seam which preferably is tight enough to be concealed by application of the final finish coating or paint. If spackling is require, a single thin application would be sufficient without the need for taping the joint and successive iterations of spackling and sanding typically encountered with wide drywall joints. In some embodiments, slightly beveled or chamfered corner may be provide between the bottom surface 304 and peripheral sides 360 along the entire perimeter of each ceiling panel to conceal any slight irregularities in the edges between adjoining ceiling panels.

Additional ceiling panels may then continue to be installed in the same longitudinal row (direction) using the same process described and shown in steps (1) and (2). Following completion of the longitudinal row of ceiling panels, a second longitudinal row of laterally adjacent ceiling panels is next illustrated in the present installation process. It will be appreciated however that a full longitudinal row of ceiling panels need not be installed until adjacent longitudinal row ceiling panels can be installed. Alternatively, lateral rows of ceiling panels may be installed first. Furthermore, various select sections of ceiling panels may be installed by mounting panels in the both the longitudinal and lateral directions, as illustrated below.

Referring now to FIGS. 7-10, ceiling panels located laterally adjacent to already installed ceiling panels 300*b* and 300*c* will be installed next. A third ceiling panel 300*e* is installed in step (3) which is connected to previously-mounted ceiling panel 300*c*. The longitudinal tongue 360 on panel 300*e* is fully inserted into the longitudinal groove 370 presented beneath the longitudinal mounting flange 343 of ceiling panel 300*c* already attached to the support grid 209. The longitudinal and lateral mounting flanges 343 of panel 300*e* are positioned beneath and then attached along two peripheral sides 306 to bottom flanges 210 of intersecting longitudinal and lateral grid support members 202, 204 (see also FIG. 3). Ceiling panel 300*e* is now fully perimeter mounted and supported by both the support grid 209 and ceiling panel 300*b*. The longitudinal and lateral mounting flanges 343 of panel 300*e* are positioned beneath and then attached along two peripheral sides 306 to bottom flanges 210 of intersecting longitudinal and lateral grid support members 202, 204 (see also FIG. 3). Panel 300*e* is now fully perimeter mounted and supported.

A fourth ceiling panel 300*d* may next be installed in step (4) by connecting the panel to both previously-mounted ceiling panels 300*b* and 300*e*. The longitudinal and lateral tongues 360 of panel 300*d* are inserted into the longitudinal and lateral grooves 370 of ceiling panels 300*b* and 300*e*, respectively. The longitudinal and lateral mounting flanges 343 of panel 300*d* are positioned beneath and then attached along two peripheral sides 306 to bottom flanges 210 of intersecting longitudinal and lateral grid support members 202, 204 (see also FIG. 3). Panel 300*d* is now fully perimeter mounted and supported. The process may be continued by mounting additional ceiling panels either longitudinally or laterally adjacent to the installed panel.

FIG. 11 shows the four installed ceiling panels 300*b*, 300*c*, 300*d*, and 300*e*. As illustrated by panel 300*d*, a portion of the mounting flanges 383 of four panels contact the four grid support members 202, 204 defining each grid opening of the ceiling support grid 209. Viewed another way, panel 300*d* is completely framed by the four mounting flanges.

It will be appreciated that ceiling panels preferably are installed in an order or sequence in which there is always a previously-mounted ceiling panel having an exposed mounting flange 343 available. This is because the mounting flanges cannot be fastened to the support grid 209 if there already is an installed panel covering the grid face due to the shiplap edge detail. Ceiling panels may be cut or otherwise factory formed to allow installation along the perimeter of the ceiling system 100 adjacent the vertical walls of the building space where the normal installation method and sequence using the hybrid edge details cannot be fully used.

According to further aspects of the invention, a multi-layered final facing system may be provided for ceiling panels 300 which creates the exposed bottom surface of the ceiling system visible to room occupants. The facing system is intended and configured to preserve or enhance the acoustical properties (e.g. NRC, CAC, etc.) of the ceiling panel substrate.

Figure 12:
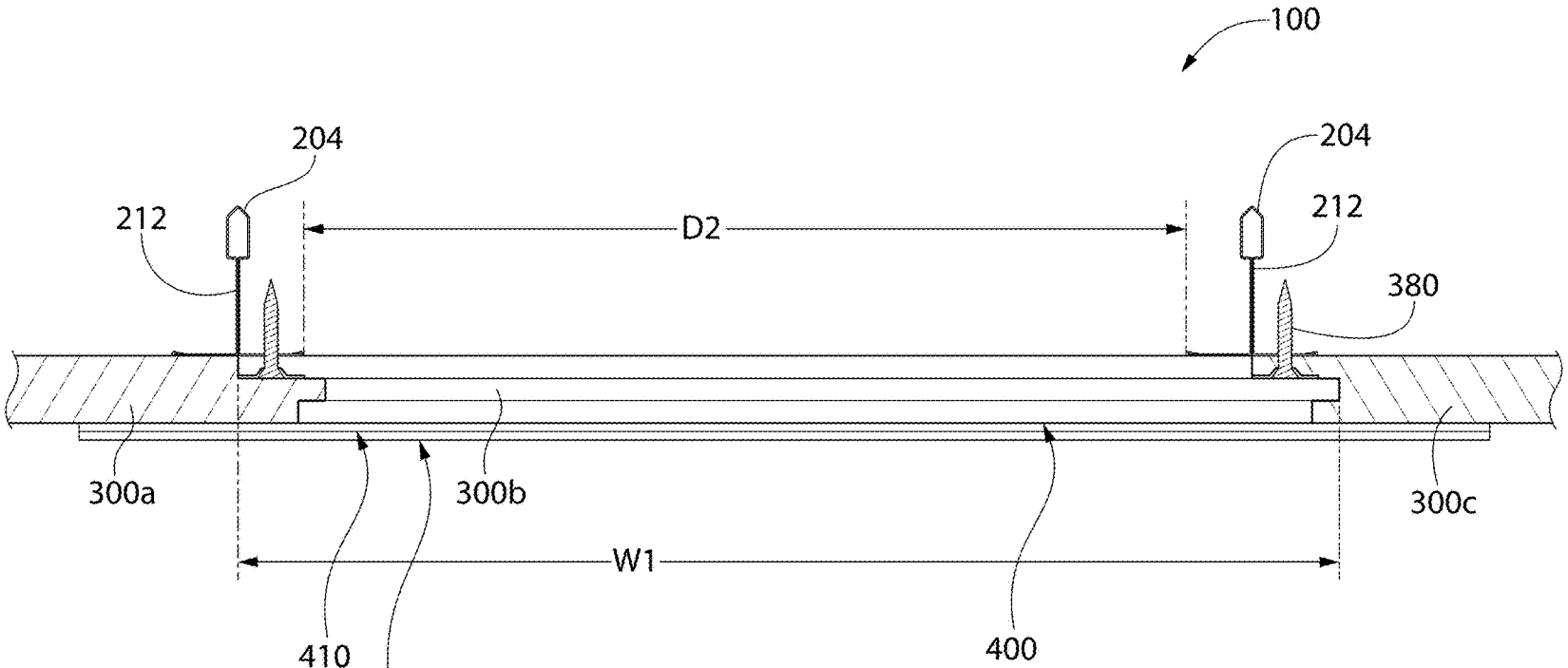
FIG. 12 is a side elevation view of a ceiling panel with hybrid edge detail according to the present disclosure having a field applied final facing system.

Referring to FIG. 12, the facing system initially includes an appropriate treatment applied to the bottom surface 304 of the ceiling panel substrate to prepare the surface for placement and proper adherence or bonding of the final scrim layer or facing 420 to the panel. In some embodiments, the surface treatment layer 400 applied to the ceiling panel substrate may include coatings or facing with filled, unfilled, and/or painted nonwoven scrim. Examples of suitable surface treatment materials used may include, for example without limitation, non-woven fiberglass or polymeric scrim possessing sufficient inherent repellency or filled, treated or coated scrim for repellency, typically in the thickness range of about and including but not limited to 0.010 to 0.125 inches. Highly open coatings with a low air flow resistance (<100 mks Rayls) may be used to enhance sound absorption. The surface treatment layer 400 may be applied in the factory or the field in various implementations. The surface treatment may be beneficial for use in situations when the open nature of the acoustic substrate (panel) would readily absorb the adhesive applied in field applications. The surface treatment layer 400 preferably provides sufficient hold out for the adhesive (i.e. anti-penetration into the substrate) while allowing for adhesion of the facing and acoustical performance.

In some embodiments, the joints or seams 390 formed between adjoining interlocked ceiling panels such as shown in FIG. 12 may optionally be taped prior to application of the final facing if desired; however, this is not necessary in all situations when using the final facing system described herein.

In one exemplary embodiment, the final facing layer 420 is preferably but not necessarily adhered to the hung treated ceiling panel substrate in the field such as by use of a suitable adhesive. This allows concealment of the field-formed joints between 390 between ceiling panels 300 after they are hung from the support grid 209. The adhesive layer 410 is applied directly to the surface treatment layer 400 using a suitable thickness of adhesive to properly bond the final facing layer 420 to the treated substrate. In various embodiments, permanent or releasable type adhesives may be used and applied by any suitable means (e.g. spraying, rolling, etc.). Suitable adhesives that may be used in field applications for adhesive layer 410 include for example, without limitation, a shear thinning adhesive with high wet tack such as used in wall paper (e.g. Roman Pro-880 clear strippable wallcovering adhesive from Roman Decorating Products or others). For pre-applied facing (factory applied finished face), an activated adhesive such as a hot melt film may be used. Other suitable adhesives may include solvent or water activated adhesives, pressure sensitive adhesive tapes, or applied polymer emulsion adhesives.

The final facing 420 provides the aesthetic look and the appropriate acoustical characteristics for the specified application. In some embodiments, suitable materials that could be used for facing 420 are nonwoven (glass filled or pre-painted), fabric, or perforated materials. Other suitable facing materials include fiberglass or polymeric non-wovens (filled or unfilled/finished or unfinished), fabrics, or perforated films. Exemplary non-limiting thicknesses that may be used for the final facing material are thicknesses in a range from about and including 0.010 to 0.150 inches. The limiting factors on types and thicknesses of facing materials used include economics, acoustics, and final visual appearance.

Depending on the type of facing product used, facing 420 may be embodied in sheets or rolls of material for application to the ceiling panels in the field. In some non-limiting examples, rolls of facing 4 feet in width may be provided.

The facing 420 may have a rectilinear shape in some embodiments. In certain non-limiting exemplary embodiments, the final facing 420 may have a width larger than at least one of the width W1 and length L1 of the ceiling panels 300. The facing 420 may also have a length (the dimension perpendicular to the width of facing) larger than at least one of the width W1 and length L1 of the ceiling panels 300. In some embodiments, the length of the facing 420 is larger than both the width W1 and length L1 of the ceiling panels 300.

An exemplary method for facing a ceiling system in the field (i.e. jobsite) to create a monolithic appearance will now be described with reference to FIGS. 13-15. These figures show sequential bottom plan views of the ceiling system 100 during application of the final facing 420. The grid support system 200 and ceiling panels 300 are first installed using the mounting flanges 342, and tongue-and-groove and shiplap edge details as already described above and shown in FIGS. 10 and 11.

Figure 13:
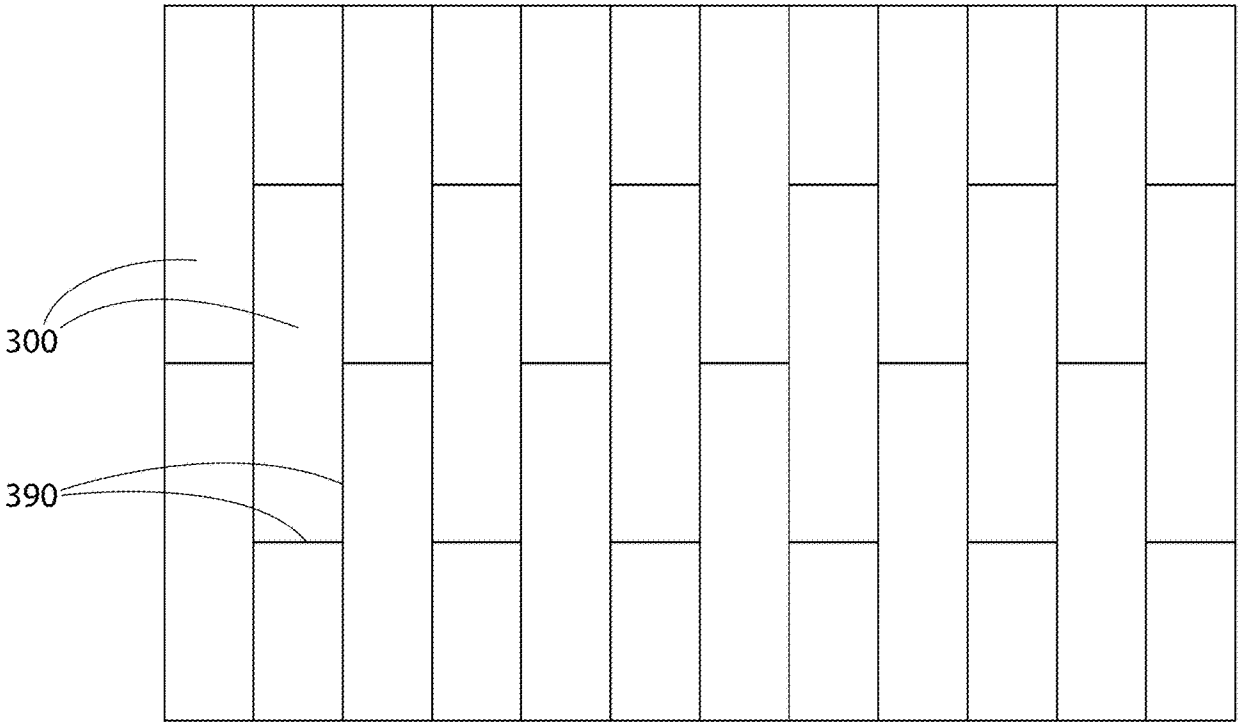
FIGS. 13-15 are bottom plan views of the faced ceiling system of FIG. 12 showing sequential steps in attaching the facing system to the ceiling panels.

In this exemplary method, it will be assumed for convenience without limitation that the array of ceiling panels 300 are arranged in a running bond pattern with offset staggered lateral joints 390 between adjacent longitudinal rows of ceiling panels as shown in FIG. 13. The ceiling panels 300 may each measure 2 feet wide by 8 feet long in this non-limiting example with the support grid 209 having grid openings 208 sized commensurately. As seen, a plurality of longitudinal joints is formed between laterally adjoining peripheral edges of the ceiling panels 300. Similarly, a plurality of lateral joints is formed between longitudinally adjoining peripheral edges of the ceiling panels. At this juncture in the facing process, the longitudinal and lateral joints 309 between ceiling panels are still visible.

The facing process begins by first applying a surface treatment layer 400 to the bottom surfaces 304 of the ceiling panels before bonding the final facing 420 thereto. This prepares the surfaces for adhesive mounting of the facing. In some embodiments, depending on the ceiling panel material used, the surface treatment may not be needed to properly bond the facing to the ceiling panel in which case the treatment may be omitted.

An adhesive layer 410 is next applied to the treated bottom surface 304 of the ceiling panels 300. To ensure maximum adhesive strength for bonding the facing 420 to the ceiling panels, the adhesive and facing may be applied to the ceiling panels working a section or region at a time to prevent excessive drying out of the adhesive.

The final facing 420 which will be visible to room occupants is next applied. The facing 420 may be provided in a variety of sizes and formats (e.g. rolls, sheets, etc.). Preferably but not necessarily, the facing 420 has a continuous uninterrupted length in some embodiments substantially greater than the length L1 or width W1 of any individual ceiling panel. This allows the facing 420 to cover the bottom exposed surface area of a plurality of ceiling panels 300 (see, e.g. FIGS. 14 and 15). In this non-limiting example, the facing 420 may be 4 feet wide and may be provided in roll form with the length of the facing being substantially greater than the width. Any length or width of final facing may be provided in roll form with the length and width being determined by the design and jobsite requirements, and handling considerations. Non-roll form sheets final facing of any suitable length and width may alternatively be used.

The facing 420 will be run in a lateral direction in this example (from left to right in FIG. 13); however, in other embodiments the facing be run in the longitudinal direction (from top to bottom in FIG. 13). In other embodiments, the facing 420 may be run in diagonal directions at an oblique angle to the longitudinal and lateral directions.

The desired length of facing 420 is first measured and then cut from the roll such as with a utility knife.

Figure 14:
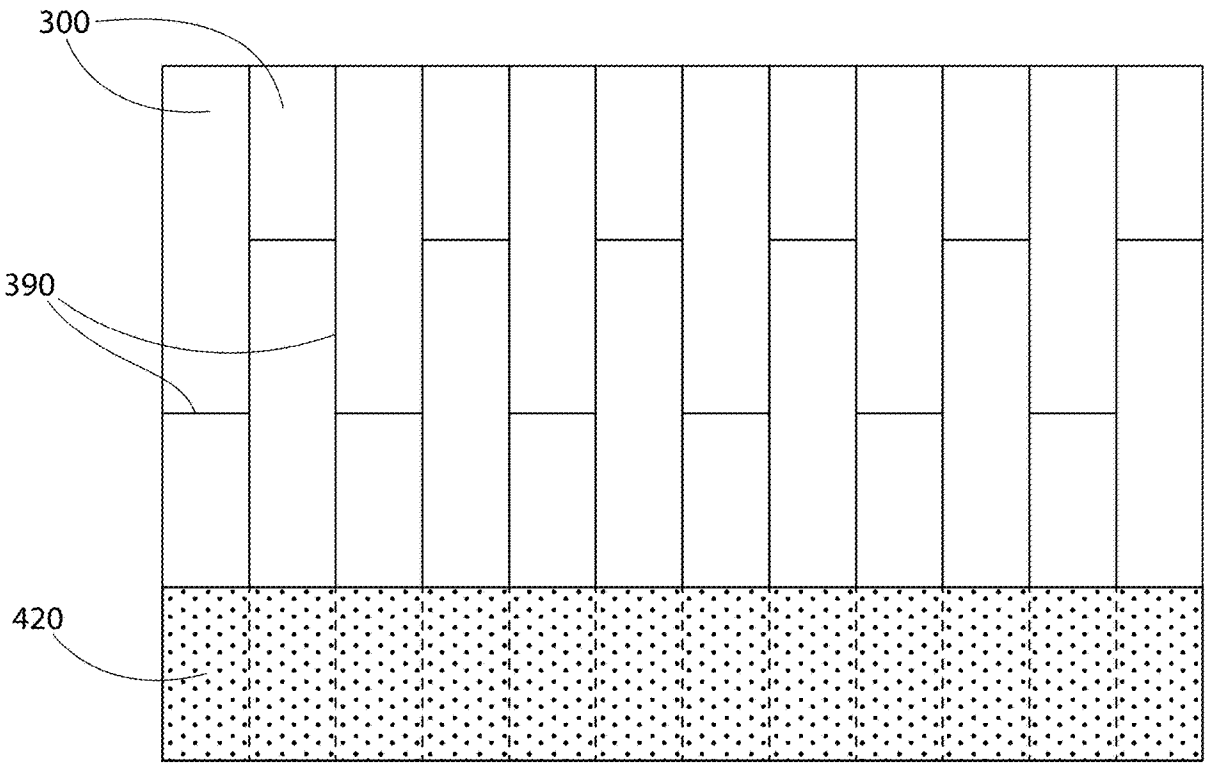

With the adhesive layer already applied to a section of the hung ceiling panels (comprising part or all of the bottom surfaces 304 of multiple panels), a first lateral row of final facing 420 is adhesively bonded to the treated or untreated bottom surfaces 304 of ceiling panels as shown in FIG. 14. The facing 420 spans across and conceals multiple portions of the longitudinal joints 390 (represented by dashed lines beneath the facing). In this non-limiting example, the facing 420 has a length equal to the combined widths W1 of 12 ceiling panels. The facing in this non-limiting example also falls directly on or near multiple lateral offset joints as seen along the top peripheral edge of the facing thereby partially or completely concealing those joints. In other embodiments contemplated, facing 420 with a larger width than 4 feet used in this non-limiting example (e.g. 5 or 6 feet) may be used which would cover additional lateral joints completely.

Figure 15:
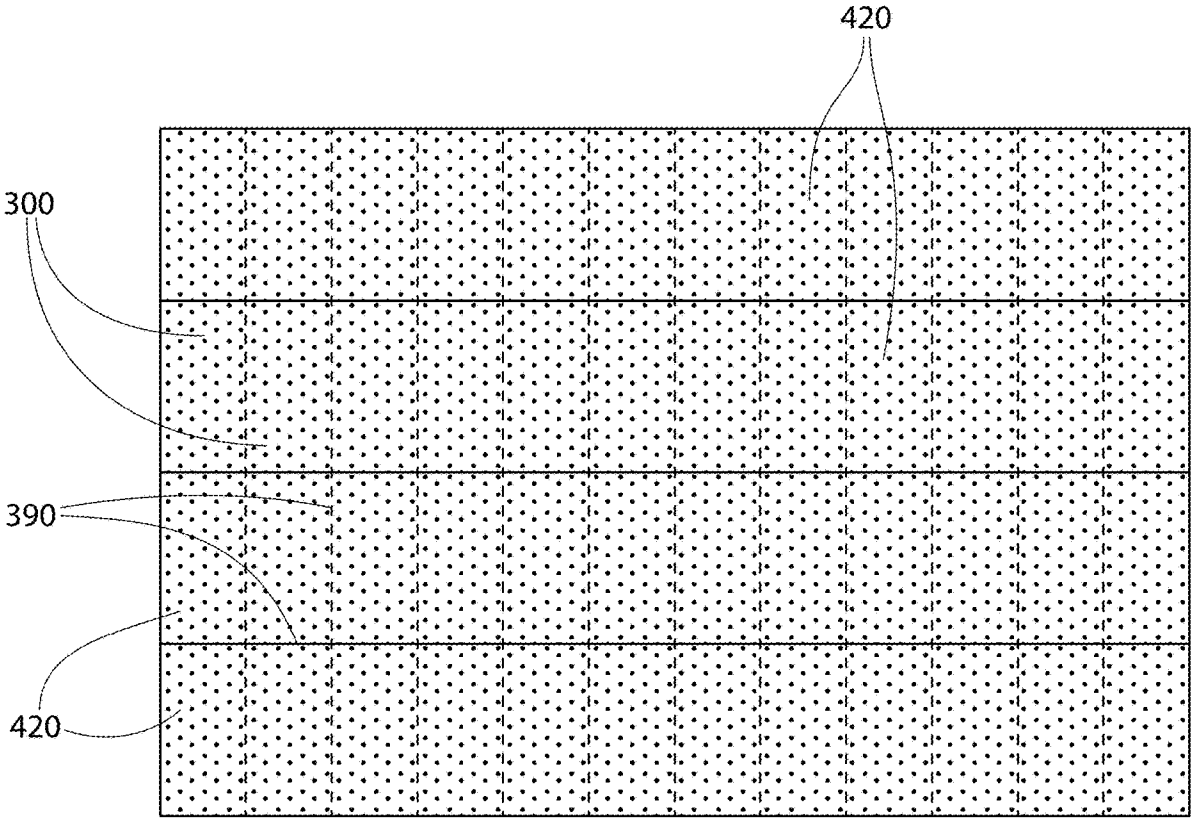

Second and additional lateral rows of facing 420 are applied to the remaining ceiling panels 300 in a similar manner until the entire exposed bottom surfaces 304 of the ceiling panels are covered, as shown FIG. 15. Preferably, the seams formed between adjoining peripheral edges of rows of facing are abutted as tightly as possible to minimize any gaps therebetween and their visibility.

The final facing 420 results in a plurality of laterally extending seams formed between adjoining lateral rows facing. This results in a few number of facing seams than the multiple longitudinal and lateral joints 390 between the ceiling panels 300. Advantageously, the final facing 420 with extremely sharp and straight peripheral edges generally allows creation of tighter and narrower seams between adjoining sheets of facing (somewhat analogous to seams between adjoining sheets or runs of wallpaper). These narrow seams are less visually noticeable than joints 390 between adjoining ceiling panels 300, thereby creating a monolithic ceiling appearance. If the facing 420 is a paintable type, the finish coat of paint may entirely fill and conceals any seams between the rows or sheets of facing.

It will be appreciated that the joints 390 between adjoining ceiling panels 300 are covered by a single uninterrupted length of facing 420 which bridges the joints, rather than by applying joint compound tape or a similar material thereby avoiding the use of joint compound altogether for purposes of concealing the joints. Accordingly, the faced ceiling system 100 with monolithic ceiling appearance described herein advantageously may be installed without use of any joint or spackling compound.

Although ceiling panels 300 are disclosed herein in one non-limiting embodiment as having a hybrid peripheral edge detail, it will be appreciated that other types of edge details and combinations of different type edge details may be used including edge details such as without limitation butt-joint, shiplap, tongue-and-groove, etc. The present invention is therefore not limited to panels having hybrid edge details alone.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A faced ceiling system comprising:

a ceiling support structure comprising a T-bar having a bottom flange, the bottom flange including an upward facing top surface that is opposite a downward facing bottom support surface;

a plurality of acoustic ceiling panels each having a width, a length, a top surface facing the ceiling support structure, an opposing bottom surface facing an interior space below the ceiling panels, and a plurality of peripheral edges extending between the top and bottom surfaces, the plurality of peripheral edges comprising:

a first edge having a groove, the first edge comprising a first mounting flange having a top surface opposite a bottom surface and an end surface extending therebetween, the bottom surface of the first mounting flange forming a ceiling of the groove, the end surface extending beyond the bottom surface of the ceiling panel, and the top surface of the ceiling panel comprising the top surface of the first mounting flange and the top surface of the first mounting flange abuttingly engaging and attached to the downward facing bottom surface of the ceiling support structure, and a second edge opposite the first edge, the second edge having a tongue configured to be inserted into the groove of the first edge;

a plurality of laterally spaced apart joints formed between mating the first and second edges of adjoining ceiling panels;

a facing sheet adhesively bonded to the bottom surfaces of at least two ceiling panels, the facing sheet extending continuously across the bottom surfaces of the at least two ceiling panels to conceal the joint formed therebetween, the facing sheet extending a distance that is larger than a lateral width of the at least two ceiling panels combined; and a fastener extending between the top and bottom surfaces of the first mounting flange and into the T-bar such that the fastener extends beyond the upward facing top surface of the bottom flange of the T-bar.

2. The ceiling system according to claim 1, wherein the facing sheet covers at least two joints formed between adjoining ceiling panels.

3. The ceiling system according to claim 1, wherein the facing sheet covers substantially the entire bottom surfaces of the at least two ceiling panels.

4. The ceiling system according to claim 1, wherein the facing sheet is formed of a material selected from the group consisting of nonwoven filled material, nonwoven prepainted material, a fabric, and a perforated material.

5. The system according to claim 1, wherein the top surface of the first mounting flange is flush and coextensive with the top surface of the ceiling panel.

6. The system according to claim 1, wherein the first edge of each ceiling panel comprises a second mounting flange having a top surface opposite a bottom surface and an end surface extending therebetween, wherein the top surface of the second mounting flange forms a floor of the groove.

7. The system according to claim 6, wherein the bottom surface of the second mounting flange is flush and coextensive with the bottom surface of the ceiling panel.

8. The system according to claim 6, wherein the end surface of the first mounting flange extends beyond the end surface of the second mounting flange.

9. The system according to claim 6, wherein the groove comprises a stop wall that extends from the bottom surface of the first mounting flange to the top surface of the second mounting flange.

10. The system according to claim 9, wherein the end surface of both the first and second mounting flanges extend beyond the stop wall of the groove.

11. The system according to claim 1, wherein the acoustic ceiling panel comprises mineral fiber.

12. The system according to claim 11, wherein for two adjoining ceiling panels, the tongue of a first ceiling panel conceals the fastener extending through the second ceiling panel.

13. A ceiling system comprising:

a grid support system comprising a plurality of intersecting grid support members, the grid support members each comprising a T-bar having a bottom flange, the bottom flange including an upward facing top surface that is opposite a downward facing bottom support surface;

a plurality of acoustic ceiling panels attached to the downward facing bottom support surfaces of the grid support system, each ceiling panel including a pair of opposed peripheral edges extending between an upper surface and a lower surface, the pair of opposed peripheral edges including a tongue-and-groove portion and a shiplap portion;

a plurality of laterally spaced apart joints formed between mating and interlocking the tongue-and-groove portions of the opposed peripheral edges of adjoining ceiling panels; and a facing sheet adhesively bonded to the lower bottom surfaces of a plurality of ceiling panels, the facing sheet extending continuously across the bottom surfaces of at least two ceiling panels to conceal the joint formed therebetween, the facing sheet extending a distance that is larger than a lateral width of the at least two ceiling panels combined, wherein an airflow resistance as measured from the facing sheet to the upper surface of the ceiling panels is at least 0.5 NRC; and a fastener extending between the top and bottom surfaces of the first mounting flange and into the T-bar such that the fastener extends beyond the upward facing top surface of the bottom flange of the T-bar.

14. The ceiling system according to claim 13, wherein the facing sheet is formed of a material selected from the group consisting of nonwoven filled material, nonwoven prepainted material, a fabric, and a perforated material.

15. The system according to claim 13, wherein the top surface of the ceiling panel abuttingly engages and attaches to the downward facing bottom support surface of one of the grid support members.

16. The system according to claim 13, wherein the facing sheet has a thickness in a range from about 10 mils to about 15 mils.

* * * * *